US007517407B2

(12) United States Patent
Yun et al.

(10) Patent No.: US 7,517,407 B2
(45) Date of Patent: Apr. 14, 2009

(54) COOLING SYSTEM AND METHOD FOR A PAPER COATING DEVICE IN A PAPERMAKING APPARATUS

(75) Inventors: Kyung Tae Yun, Daejeon (KR); Yong Ho Jun, Chungcheongnam-do (KR); Jong Kook Jung, Daejeon (KR)

(73) Assignee: Hansol Paper Co., Ltd., Seoul (KR)

( * ) Notice: Subject to any disclaimer, the term of this patent is extended or adjusted under 35 U.S.C. 154(b) by 265 days.

(21) Appl. No.: 11/142,337

(22) Filed: Jun. 2, 2005

(65) Prior Publication Data

US 2006/0032436 A1 Feb. 16, 2006

(30) Foreign Application Priority Data

Aug. 16, 2004 (KR) ..... 10-2004-0064349
Dec. 22, 2004 (KR) ..... 10-2004-0110065

(51) Int. Cl.
*B05C 1/04* (2006.01)

(52) U.S. Cl. ..... 118/101; 118/202; 118/69; 162/281; 101/157; 101/169; 101/365

(58) Field of Classification Search ..... 118/101, 118/202, 69; 15/256.51; 162/281; 101/157, 101/169, 365; 399/350
See application file for complete search history.

(56) References Cited

U.S. PATENT DOCUMENTS 3,134,126 A * 5/1964 Phillips ..... 15/256.51
3,701,335 A * 10/1972 Barnscheidt ..... 118/104
3,785,340 A * 1/1974 Stafford et al. ..... 118/101
4,258,650 A * 3/1981 McCrocklin et al. ..... 118/101
5,219,618 A * 6/1993 Daniels ..... 427/356
5,454,881 A * 10/1995 Fischer ..... 148/241
5,567,479 A * 10/1996 Rantanen ..... 427/359
6,065,402 A * 5/2000 Feller et al. ..... 101/350.5
6,374,769 B1 * 4/2002 Pesavento et al. ..... 118/46

FOREIGN PATENT DOCUMENTS

EP 0864691 * 9/1998
JP H4-228700 * 8/1992

* cited by examiner

*Primary Examiner*—Laura Edwards
(74) *Attorney, Agent, or Firm*—Whitham Curtis Christofferson & Cook, PC

(57) ABSTRACT

A cooling system and method for a paper coating device, especially for cooling a coating blade of the coating device and a coating color to be coated on paper web, whereby a streaking and/or bleeding phenomena caused by accumulation of the coating color at the end of the coating blade are effectively inhibited. The cooling system comprises a cooling means equipped at a back surface of the coating blade, interconnecting hoses for communicating coolant to the cooling means, a circulating unit, and a heat-exchanging unit.

15 Claims, 8 Drawing Sheets

Coating color Collection

Coating color Collection

PRIOR ART

COOLING SYSTEM AND METHOD FOR A PAPER COATING DEVICE IN A PAPERMAKING APPARATUS

CROSS REFERENCE TO RELATED APPLICATION

This application is based on, and claims priorities to Korean Patent Applications Nos. 10-2004-0064349 and 10-2004-0110065, filed on Aug. 16, 2004 and Dec. 22, 2004, respectively, the disclosure of which is hereby incorporated by reference.

TECHNICAL FIELD OF THE INVENTION

The present invention relates to a cooling system and a cooling method for a paper coating device of a paper_coating apparatus. More particularly, the cooling system and the cooling method for a paper coating device is provided with a coating blade having a cooling means, thereby effectively preventing a stalagmite formation of a coating color at the end of the coating blade.

BACKGROUND OF THE INVENTION

A manufacture of paper typically comprises steps of preparing paper stock, making a paper web, coating the paper web with an appropriate coating color, and finishing the paper web. In the process of preparing the paper stock, a pulp is extracted from wood or other fiber plant by chemical or mechanical treatment. In particular, in order to obtain the pulp, wood or other fiber plant is supplied to a barker so as to peel. Subsequently, the peeled wood or other fiber plant is transferred to a grinder, in which the wood or other fiber plant is mixed with water and ground in the form of slurry. Finally, the pulp for papermaking is prepared by screening the slurry.

On the other hand, the paper stock may be obtained from other materials such as a chemical pulp or a DIP (De-Inking pulp). The paper stock sequentially goes through several basic processes such as papermaking, coating and finalizing, and other additional processes subject to special requirements, thereby being formed into a web of paper wound around a roller.

In detail, the papermaking process is divided into an injecting process for uniformly injecting the paper stock, a distributing process for leveling the injected paper stock, a pressing process for pressing and dewatering the paper stock by means of a press roll, a pre-drying process for firstly drying the paper stock in the form of a web, an after-drying process for balancing the moisture contained in the web of paper, a leveling process for adjusting the thickness and smoothness of the paper web by using a pressing roll, and a winding process for winding the paper web around a roller.

The coating process, in which a paper web is coated with an appropriate coating color by a coater, specifically comprises processes of unwinding the paper web from the roller, applying a coating color (pigments, binders and additives) to the surface of the paper web in order to provide therewith smoothness or gloss, drying the paper web coated with the composition by means of steam or hot air, and re-winding the paper web around the roller.

A conventional coater employed in the above coating process will be explained in detail below with reference to the accompanying FIGS. 7 and 8.

The coater includes a backing roll 20 that transfers paper web 10 to be coated while supporting the paper web 10. Disposed adjacent to the lower end of the backing roll 20 is a nozzle 18 for injecting coating color 12 to the surface of the paper web 10. The coater further comprises a coating blade 14 which applies the coating color 12 to the paper web 10 in an evenly distributed manner. The coating blade 14 is configured to be biased against the surface of the backing roll 20. In addition, the coater is provided with a profile tube 16 positioned at the outer side of the coating blade 14 for configuring the profile of the coating blade 14 and a base 22 on which the profile tube 16 is mounted.

The width of the coating blade 14 is substantially the same with the width of the backing roll 20, whereby the coating blade 14 enables to doctor the surface of the paper web 10 in a time, over which the injected coating color 12 is disposed.

As shown in FIG. 7, the paper web 10 is continuously transferred via the rotation of the backing roll 20 while tightly partially contacting to the surface of the backing roll 20. To the surface of the paper web 10 a nozzle 18 injects a coating color 12 and the coating blade 14 evenly distributes and applies the coating color 12 over the surface of the paper web 10. During the application of the coating color 12 on the paper web 10, the excess of the coating color 12 is removed by the coating blade 14. Such a process is called as a metering process. (see the attached FIG. 8)

The metering process can be adjusted by shifting the position of the coating blade 14, which can be conducted by controlling a cylinder built in the profile tube 16 so that the desired amount of the coating color can be applied to the paper web 10. In order to collect the excess of the coating color removed during metering process, a collecting means 40 is furnished below the nozzle 18.

However, such a conventional coater has disadvantages as follows.

Referring to FIG. 7, some of the coating color 12 is accumulated at the distal end of the coating blade 14 due to the increase of the density thereof while passing between the coating blade 14 and the paper web. The accumulated coating color becomes bigger and ultimately forms a stalagmite that leads to occurrence of scratches on the paper web and transference of the stalagmite to the paper web.

In particular, at high speeds of the paper web the density of the coating color instantaneously increases passing through the coating blade due to high shear stress applied thereon and abrupt dewatering by a pressure, which results in occurrence of bleeding or streaking at the distal end of the coating blade. Such an accumulation of the coating color ultimately forms a stalagmite leading to imperfection of coated paper.

In this regard, U.S. Pat. No. 5,219,618 (Jun. 15, 1993) discloses a device that prevents a formation of a stalagmite by spraying fluid to the end of a blade and coating color.

Moreover, Japanese unexamined patent publication No. H4-228700 (Aug. 18, 1992) also discloses a device capable of inhibiting the formation of a stalagmite, wherein an injecting means are provided so as to spray fluid to a boundary area between paper web and the downstream of the coating blade. The above-described prior arts are characterized in preventing a formation of the stalagmite by providing a spraying means of fluid.

Under this circumstance, it has been strongly demanded to provide a paper coating device and system capable of effectively preventing the increase of the density of coating color while maintaining moisture. Further, it has been demanded to provide a paper coating device and system capable of significantly reducing a bleeding and streaking phenomena during a paper coating operation, thereby improving productivity and quality of coated paper.

SUMMARY OF THE INVENTION

It is therefore an object of the present invention to provide a cooling system and method for a paper coating device in a paper_coating apparatus, especially for cooling a coating blade of the coating device and a coating color to be coated on paper web, whereby a streaking and/or bleeding phenomena caused by accumulation of the coating color at the end of the coating blade are effectively inhibited. The cooling system comprises a cooling means equipped at a reverse surface of the coating blade, pipes for communicating coolant to the cooling means, a coolant circulating unit, and a heat-exchanging unit.

One embodiment of a paper coating device according to the present invention comprises a coating blade to apply coating color onto the paper web, a profile tube for configuring the profile of the coating blade, a cooling means for cooling down the coating blade, which is installed to a void space between the reverse surface of the coating blade and the profile tube, and a coolant circulating system for forcibly circulating the coolant through the cooling means.

Preferably, the cooling means is embodied in the form of a cooling pipe having a zigzag path, which is tightly attached to the reverse surface of the coating blade. Of course, the cooling pipe fluidically communicates with the coolant circulating system.

In another preferred embodiment of a paper coating device, the cooling means is embodied in the form of a cooling pipe having an aperture thereon for debouchment of the coolant. The cooling pipe is disposed at a lower part of the reverse surface of the coating blade.

In yet another preferred embodiment of a paper coating device, the cooling means consists of two pipes located at an upper part and a lower part of the reverse surface of the coating blade, respectively, and nozzles installed on the pipes, which are regularly spaced with each other. The nozzles directly inject the coolant against the reverse surface of the coating blade.

In yet another preferred embodiment of a paper coating device, the cooling means is embodied in the form of a cooling compartment defined by partition walls encompassing a void space between the reverse surface of the coating blade and the profile tube. The partition walls is furnished with an inlet and an outlet communicating with the coolant circulating system.

Particularly, the coolant circulating system includes a coolant tank, a coolant pump, a coolant supplying line interconnecting the coolant pump and the cooling means, and a coolant withdrawing line for redirecting the coolant being discharged from the cooling means to the coolant pump.

Preferably, the paper coating device according to the present invention is further provided with a lid for covering the upper part of the void space defined by the reverse surface of the coating blade and the profile tube in order to prevent the coolant from being dispersedly escaped. More preferably, the coolant circulating system further comprises a temperature controller in the coolant tank.

Another embodiment of a paper coating device according to the present invention comprises a baking roll for continuously transferring paper web, a nozzle for injecting coating color to the paper web, the nozzle being disposed adjacent to a lower end of the backing roll, a coating blade for applying and metering the coating color onto the paper web in an evenly distributed manner, a profile tube for configuring the profile of the coating blade, a cooling tool for cooling down the coating blade, the cooling tool installed to a void space between the reverse surface of the coating blade and the profile tube, interconnecting hoses provided at both ends of the cooling tool, a pump being in fluid communication with one of the interconnecting hoses which is for discharging the coolant from the cooling tool (hereinafter, referred to as an outlet-interconnecting hose), a heat-exchanging unit installed between the pump and one of the interconnecting hose which is for introducing coolant into the cooling tool (hereinafter, referred to as an inlet-interconnecting hose), and a refrigerator indirectly heat-exchanging with the coolant at the heat-exchanging unit via refrigerant circulating therein.

Preferably, the cooling tool is a copper pipe in which the coolant flows. The copper pipe is tightly attached to the reverse surface of the coating blade. More preferably, a coolant reservoir is further provided between the outlet-interconnecting hose and the pump.

The heat-exchanging unit is composed of a housing defining a coolant circulating compartment, an inlet and an outlet for communicating coolant, which are formed at one side of the housing, and a refrigerant circulating line which is partially introduced into the housing at the other side of the housing. Preferably, the heat-exchanging unit is further equipped with a temperature controller that senses the temperature of the coolant and accordingly adjusts the temperature of the coolant.

Interposed between the outlet of the heat-exchanging unit and the inlet-interconnecting hose is a coolant valve.

A cooling method for a paper coating device according to the present invention comprises steps of installing a cooling means at a reverse surface of a coating blade and introducing a coolant of −15° C.~25° C. into the cooling means so as to cool down the coating blade. More preferably, the temperature of the coolant to be introduced into the cooling means is −15° C.~0° C.

BRIEF DESCRIPTION OF THE DRAWINGS

The aforementioned aspects and other features of the present invention will be explained in the following detailed description, taken in conjunction with the accompanying drawings, wherein.

Figure 7:
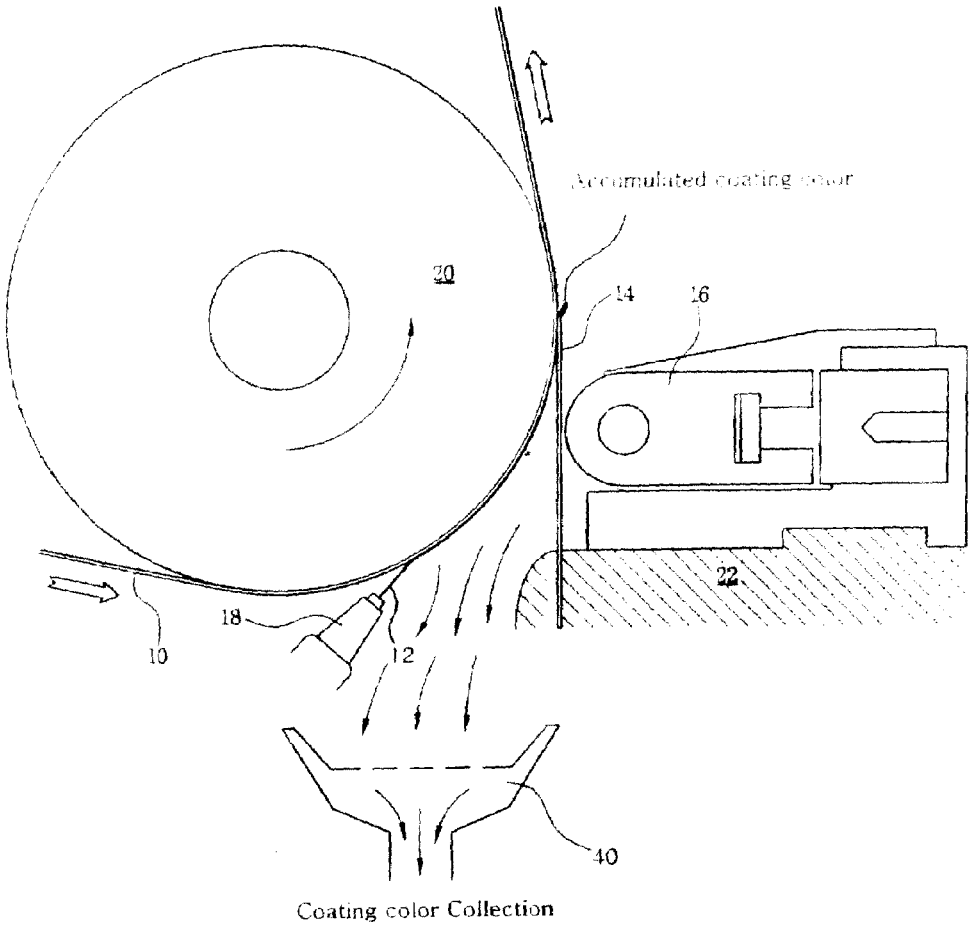
Figure 8:
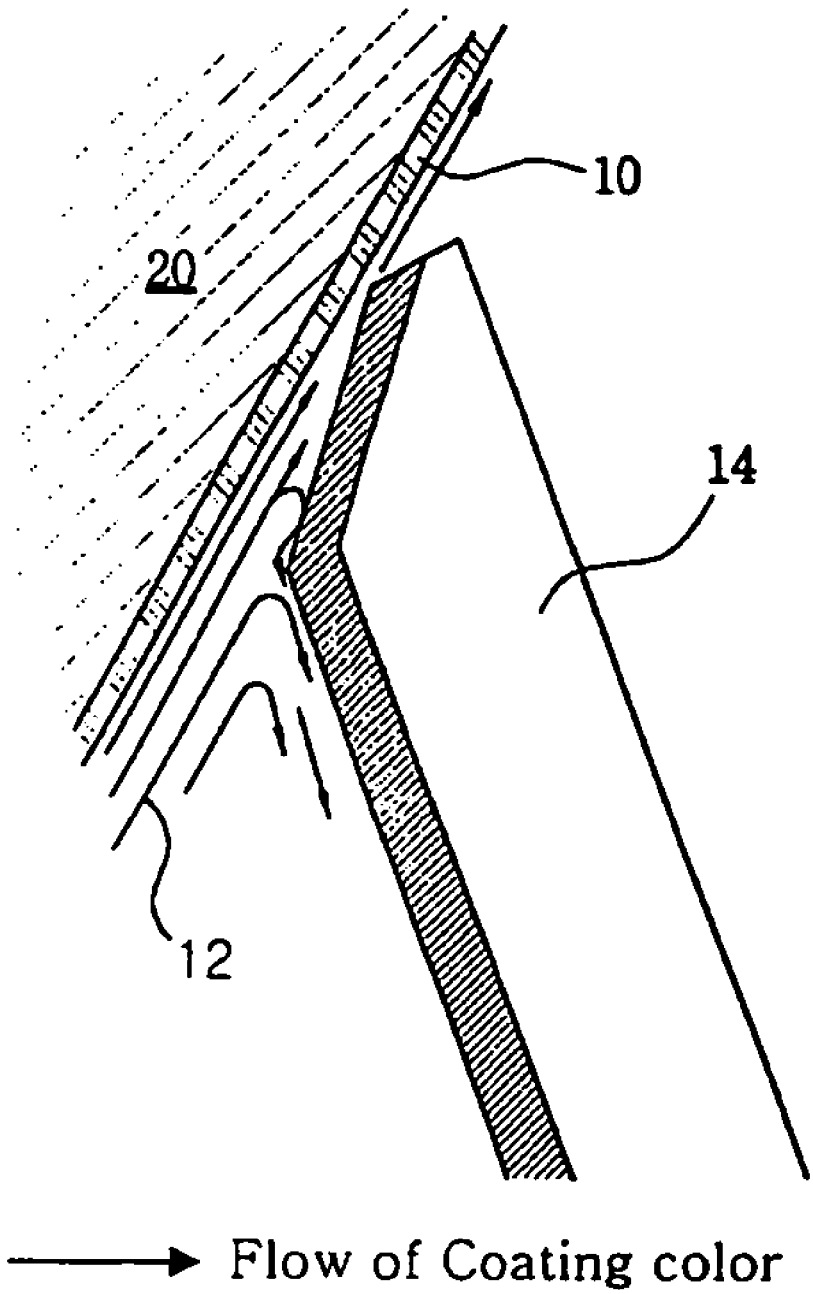

6 is a specific diagram of a cooling system employed in a paper coating device according to embodiments of the present invention;

FIG. 7 is a sectional view of a paper coating device according to a prior art; and FIG. 8 is an enlarged view of the end of a coating blade of an embodiment according to the present invention, which shows the coating blade evenly distributes and applies coating color onto the paper web.

DETAILED DESCRIPTION OF PREFERRED EMBODIMENTS

Figure 1:
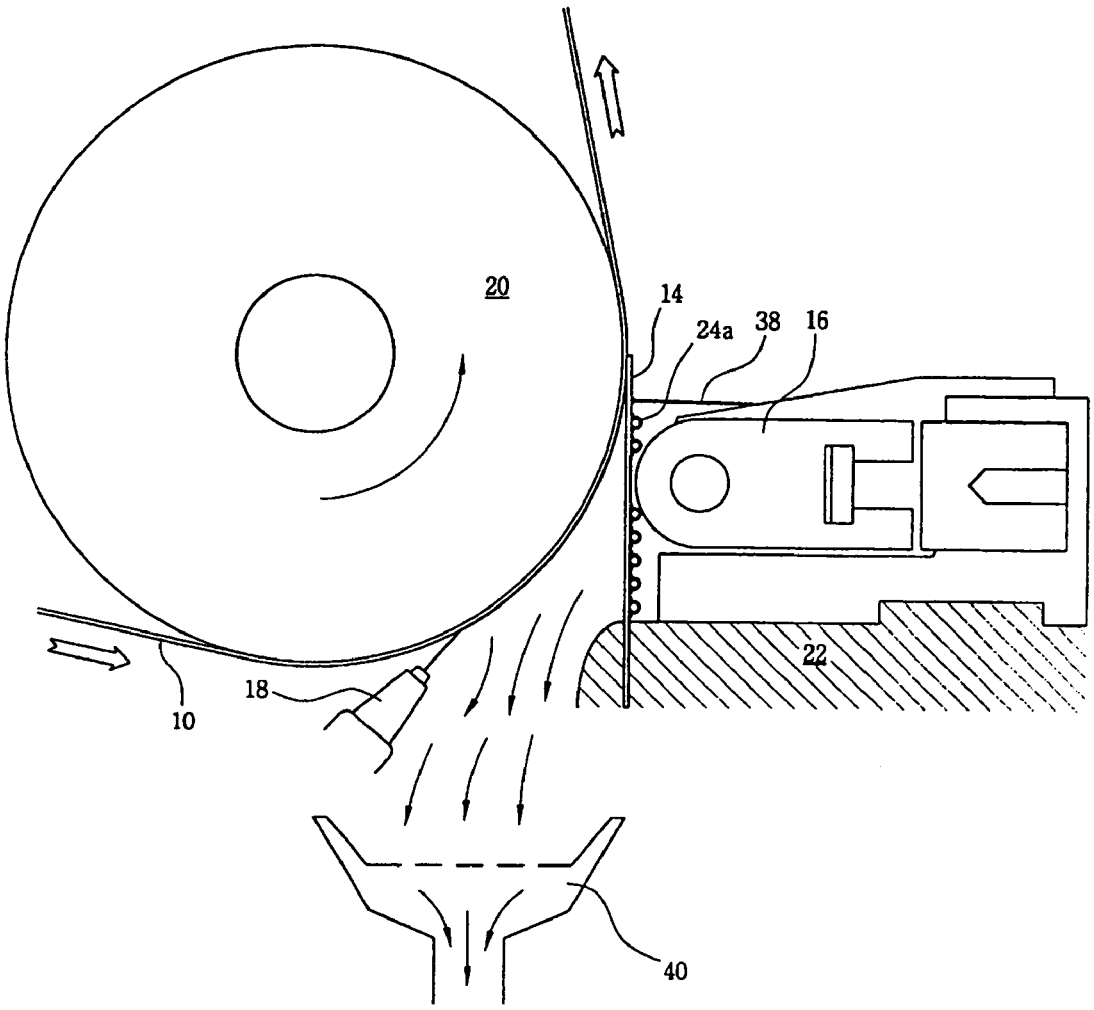
FIG. 1 is a sectional view of a paper coating device with a cooling system according to the first embodiment of the present invention.
Figure 2:
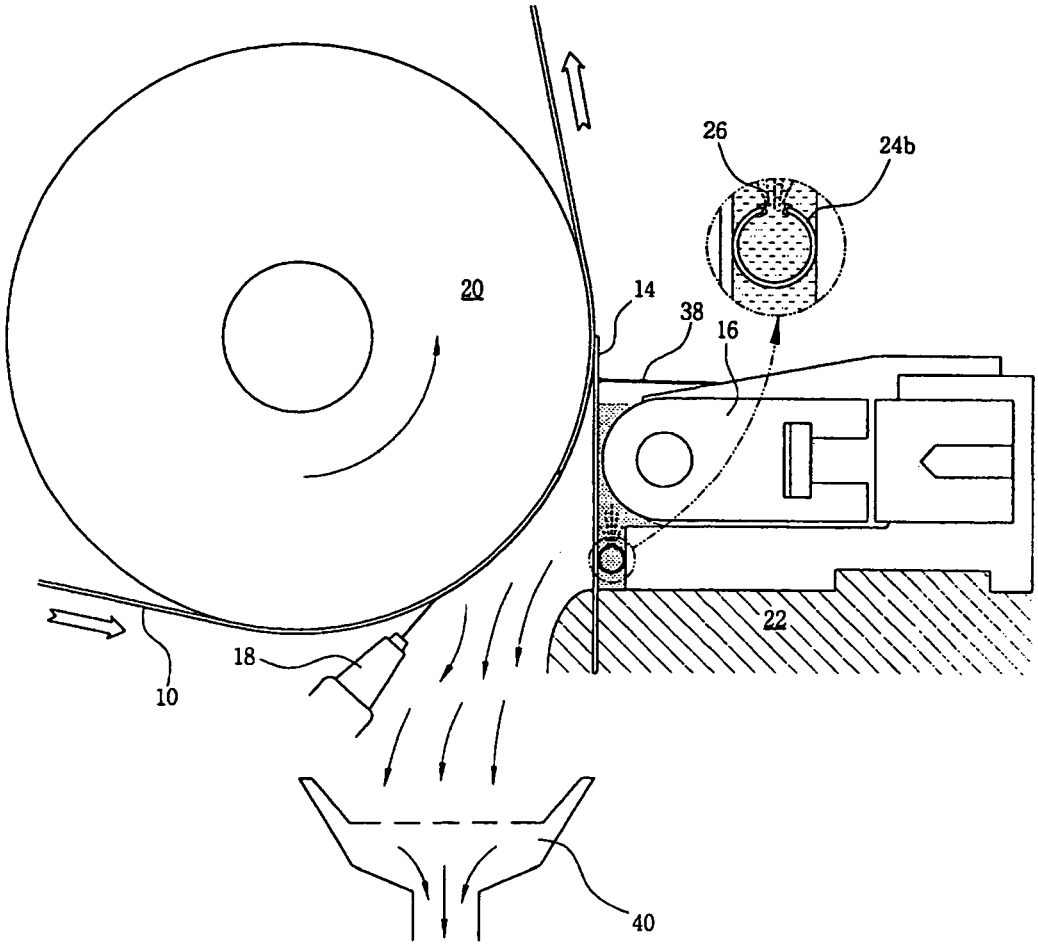
FIG. 2 is a sectional view of a paper coating device with a cooling system according to the second embodiment of the present invention.
Figure 3:
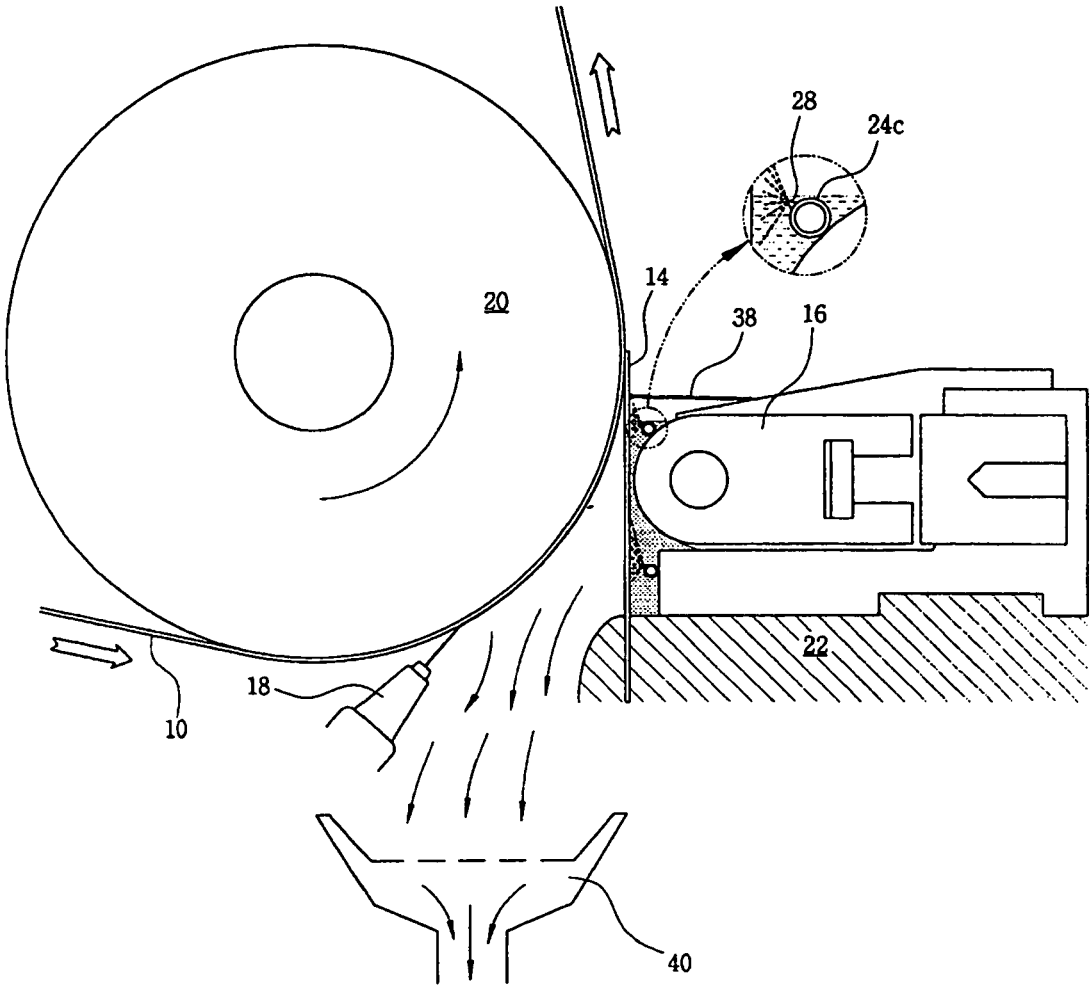
FIG. 3 is a sectional view of a paper coating device with a cooling system according to the third embodiment of the present invention.

FIGS. 1 to 3 show preferred embodiments of a paper coating device with a cooling system according to the present invention. The preferred embodiments are characterized in significantly reducing bleeding and/or streaking phenomena by cooling down a coating blade and a coating color during a coating process.

As shown in FIGS. 1 to 3, a paper coating device includes a backing roll 20 that transfers paper web 10 while rotating, a nozzle 18 for injecting coating color 12 to the surface of the paper web 10, a coating blade 14 that applies the coating color 12 to the paper web 10 in an evenly distributed manner. The coating blade 14 is configured to be biased against the surface of the backing roll 20. In addition, the coating device is provided with a profile tube 16 positioned at the reverse side of the coating blade 14 for configuring the profile of the coating blade 14, and a base 22 on which the profile tube 16 is mounted.

A cooling means for cooling down the coating blade 14 is installed at the reverse surface of the coating blade 14. Preferably, the cooling means may be installed to a void space between the reverse surface of the coating blade 14 and the profile tube 16.

Referring to FIG. 1, the cooling means is embodied in the form of a coolant pipe 24*a* through which the coolant flows. The coolant pipe 24*a* having a zigzagged shape for increasing the heat sink efficiency is firmly attached to the reverse surface of the coating blade 14.

Referring to FIG. 2, the cooling means is a cooling pipe 24*b* extending over the length of the coating blade 14 at the lower part of the coating blade 14. Of course, the cooling pipe 24*b* is in fluid communication with a coolant circulating system. At a predetermined position in the cooling pipe 24*b*, an aperture 26 for debouching the coolant is formed. The coolant debouched from the aperture 26 fills a void space between the reverse surface of the coating blade 14 and the profile tube 16, whereby the cooling of the coating blade 14 can be achieved.

Referring to FIG. 3, the cooling means consists of two pipes 24*c* located at an upper part and a lower part of the reverse surface of the coating blade 14, respectively, and a plurality of nozzles 28 installed on the pipes, which are regularly spaced with each other. The nozzles 28 directly inject the coolant against the reverse surface of the coating blade so that the cooling of the coating blade 14 can be achieved.

Even though the specific embodiment is not included in the accompanying drawings, another modification of the cooling means, such as a cooling compartment defined by partition walls encompassing a void space between the reverse surface of the coating blade and the profile tube, may be possible without departure from the sprit of the present invention. One of the partition walls defining compartment should be provided with an inlet and an outlet for communicating with the coolant circulating system.

As shown in FIG. 1 to 3, the paper coating device is provided with a lid 38 for covering the upper part of the void space defined by the reverse surface of the coating blade 14 and the profile tube 16 in order to prevent the coolant from being dispersedly escaped. The lid is preferably made of a transparent vinyl film.

Figure 4:
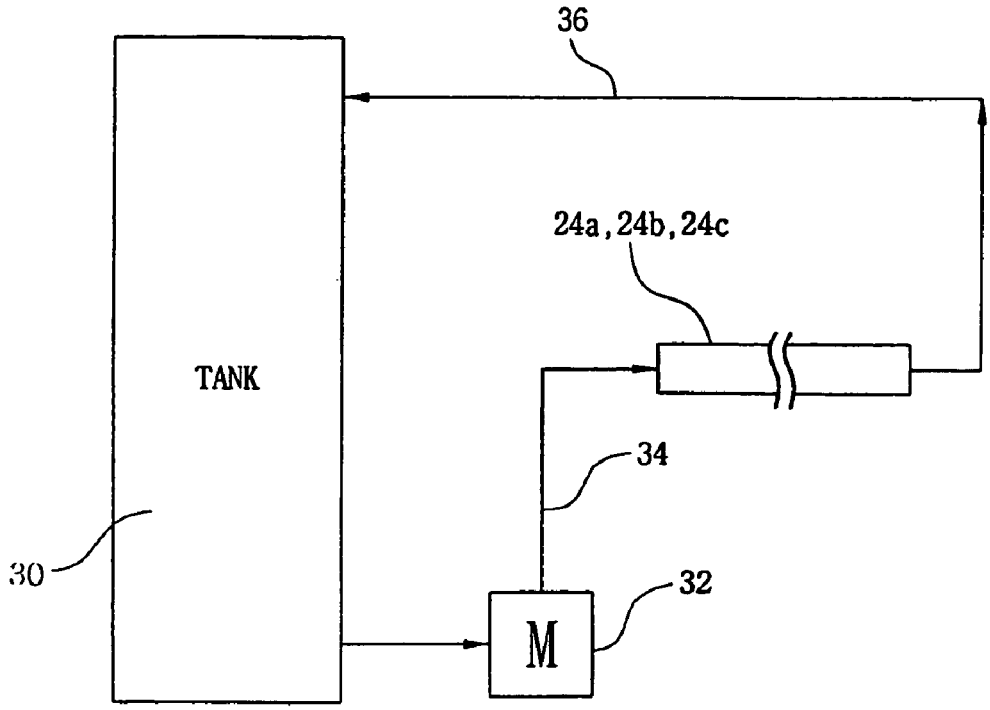
FIG. 4 is a schematic diagram showing a coolant circulating system of a paper coating device with a cooling system according to embodiments of the present invention.

As shown in FIG. 4, the coolant circulating system comprises a coolant tank 30, a pump 32 for forcibly supplying the coolant from the tank to the cooling means (24*a*, 24*b*, and 24*c*), a coolant supplying line 34 connecting the outlet of the pump 32 to the inlet of the cooling means, and a coolant withdrawing line 36 connecting the outlet of the cooling means to the coolant tank 30. In addition, the coolant circulating system is further provided with a temperature controller that maintains the temperature of the coolant within the range of from 100° C. to −15° C.

Hereinafter, the operation of a paper coating device with a cooling means according to the foregoing embodiments is described.

In the paper coating process, the backing roll 20 transfers the paper web 10 while rotating. As the paper web 10 travels over the backing roll 20, a nozzle 18 continuously injects coating color to the paper web 10. Subsequently, the coating blade 14 evenly applies the coating color to the paper web 10 and removes the excess of the coating color. Because the coating blade 14 is furnished with a cooling means (24*a*, 24*b* and 24*c*), the coating blade 14 itself and the coating color 12 directly contacting with the blade are accordingly cooled down. It facilitates to reduce friction between the paper web 10 and the coating blade 14. Ultimately, the temperature of the coating blade 14 can be maintained at least 10° C. lower than that of a conventional paper coating device.

According to the first embodiment of the cooling means shown in FIG. 1, coolant supplied from a coolant tank 30 by means of a pump is directed to flow into a coolant pipe 24*a* having a zigzag path. As the coolant pipe 24*a* is closely attached to the reverse surface of the coating blade 14, indirect cooling is accomplished by the heat exchange between the coating blade 14 and the coolant passing through the coolant pipe 24*a*. The coating blade 14 cooled by the coolant also serves to indirectly lower the temperature of the coating color 12 that is applied and metered by the coating blade 14.

According to the second embodiment of the cooling means shown in FIG. 2, coolant supplied from a coolant tank 30 by means of a pump is directed to flow into a coolant pipe 24*b* disposed adjacent to the lower end of the coating blade 14. The coolant reached to the coolant pipe 24*b* debouches via aperture 26 and fills the void space between the reverse surface of the coating blade 14 and the profile tube 16. In the light of the direct cooling method described above, it should be appreciated that such a cooling means employing the cooling pipe 24*b* is suitable for cooling a coating blade of a paper coating device in which the paper web 10 travels at high speed.

According to the third embodiment of the cooling means shown in FIG. 3, coolant supplied from a coolant tank 30 by means of a pump is directed to flow into coolant pipes 24*c* and is directly sprayed onto the reverse surface of the coating blade 14 by means of nozzles 28 installed to the coolant pipes 24*c*. Such a cooling means, the coolant pipes 24*c* with spray nozzles 28, is more efficient to cool the coating blade 14 because the coolant can directly contact with the blade. Two coolant pipes 24*c* equipped with a plurality of spray nozzles 28 are positioned at the lower portion and the upper portion of the reverse surface of the coating blade 14, respectively, thereby increasing the cooling efficiency of the coating blade by evenly distributing the coolant throughout the whole surface of the coating blade. Therefore, it should be appreciated that the cooling pipes 24*c* is suitable for cooling a coating blade of a paper coating device in which the paper web 10 travels at high speed.

In the meantime, the coolant supplied to the cooling means (24*a*, 24*b*, and 24*c*) return to the coolant tank 30 via the coolant withdrawing line 36 after exchanging heat with the coating blade 14.

The lid 38 covering the upper part of the void space defined by the reverse surface of the coating blade 14 and the profile tube 16 prevents the coolant from being dispersed to the paper web 10.

As described above, the cooling means according to the present invention can significantly reduce the sudden increase of the density of the coating color, which results in a bleeding or streaking phenomena at the distal end of the coating blade at high speeds of the paper web.

Hereinafter, one embodiment of a cooling system according to the present invention is described with reference to the accompanying FIGS. 5 and 6.

Figure 5:
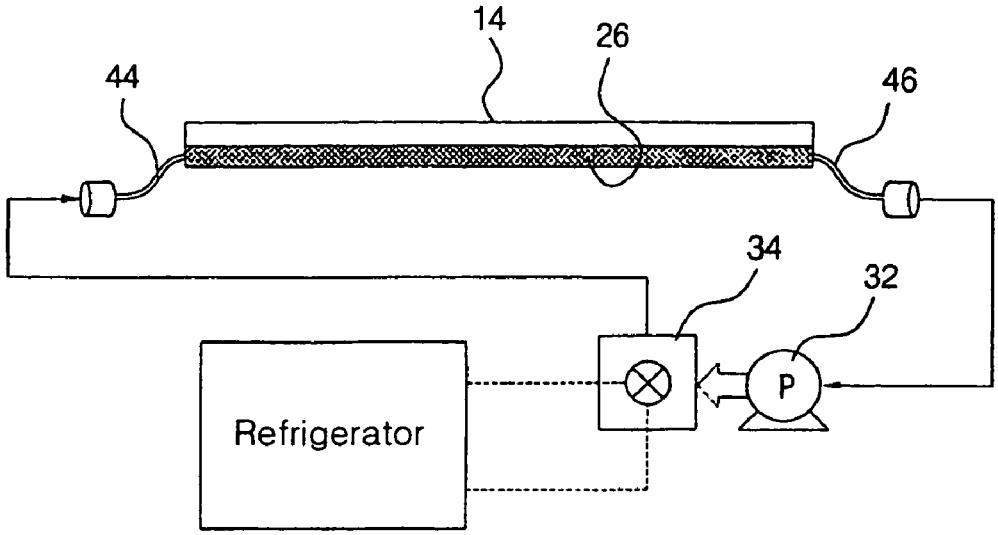
FIG. 5 is a schematic diagram of a cooling system employed in a paper coating device according to embodiments of the present invention.

FIG. 5 shows a schematic diagram of a whole cooling system including the cooling means that is specifically disclosed above. FIG. 6 shows the cooling system of FIG. 5 in detail.

Referring to FIG. 5, denoted as numeral 26 is a cooling tool substantively equivalent to a cooling means (24*a*, 24*b* and 24*c*) described above, which is adopted for cooling a coating blade of a paper coating device. Preferably, the cooling tool 26 is made of a copper pipe having a good heat-transferring property. As described above, the cooling tool 26 is tightly attached to the reverse surface of the coating blade 14.

The cooling tool 26 is provided with interconnecting hoses (44 and 46) at both ends thereof, which are made of flexible material. Preferably, the interconnecting hoses (44 and 46) are detachably connected to the cooling tool 26 by means of connectors, whereby the interconnecting hoses can be detached in the event of cleaning or maintaining.

Figure 6:
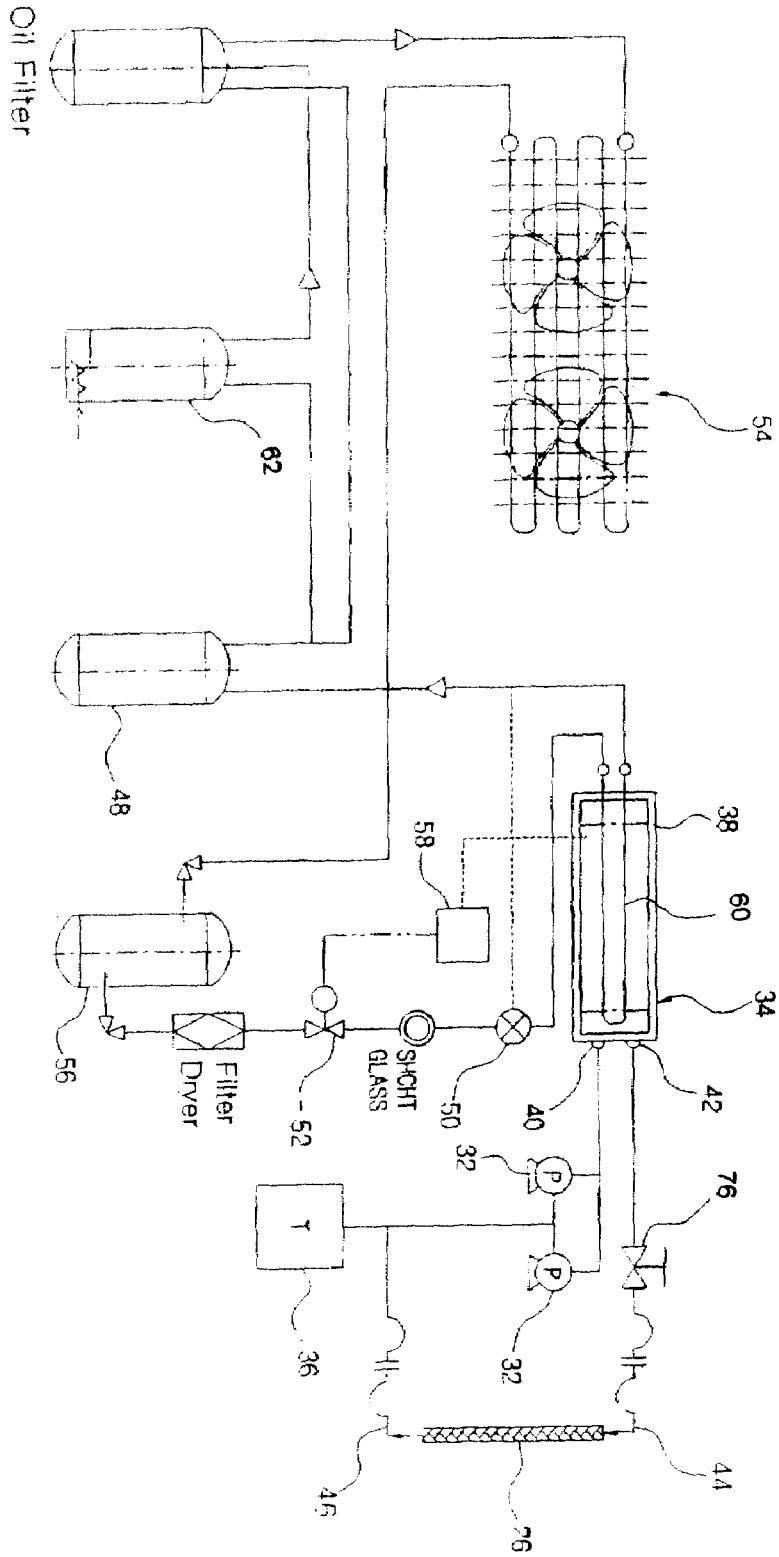

Referring to FIG. 6, one of the interconnecting hoses (44 and 46), through which the coolant flows out (hereinafter, referred to as an outlet-interconnecting hose), is connected to two pumps 32 arranged parallel with each other. One of the pumps is a primary pump for using in a normal state. The other is a supplementary pump that is for state of emergency. One of the interconnecting hoses, through which coolant flows in (hereinafter, referred to as an inlet-interconnecting hose), is connected to a heat-exchanging unit 34 in which refrigerant is circulating. In addition, a coolant reservoir 36 is interposed between the pumps 32 and the outlet-interconnecting hose 46.

The heat-exchanging unit 34 comprises a housing 38 defining a coolant circulating compartment, an inlet 40 and an outlet 42 for the coolant, which are formed at one side of the housing 38, and a refrigerant circulating line 60 which partially introduced into the housing 54. One end of the refrigerant circulating line 60 is connected to an accumulator 48 that is coupled to a compressor 62, and the other end is connected to an expansion valve 50. The expansion valve 50 is coupled to a solenoid valve 52 to which a temporary reservoir 56 is connected. The temporary reservoir 56 is in fluid communication with a condenser 54.

In addition, a temperature controller 58 is interposed between the heat-exchanging unit 34 and the solenoid valve 52. The temperature controller 58 senses the temperature of the coolant circulating in the heat-exchanging unit 34 and subsequently provides a control unit with corresponding signals. Accordingly, the control unit controls on/off operation of the solenoid valve 52 in response to the signals from the temperature controller 58, so that the refrigerant provided to the heat-exchanging unit 34 can be adjusted. Ultimately, the temperature of coolant being heat-exchanging with the refrigerant is lowered. It means that an operator can automatically maintain the coating blade at a predetermined temperature by means of the control unit. Of course, it is possible to change the predetermined temperature to another desired temperature at any time.

Disposed between the outlet 42 of the heat-exchanging unit 34 and the inlet-interconnecting hose 44 is a coolant valve 76 for controlling the flow of the coolant into the cooling tool 26. present invention employs a R-22(HCFC22) as refrigerant. The coolant used in the present invention is a brine, which serves as a heat transfer medium similar to the refrigerant. However, the brine is different from the refrigerant in that there is no phase change during a cooling cycle. Namely, the brine transfers the heat in a state of sensible heat while the refrigerant transfers the heat in a state of latent heat. In the present invention, the brine is ethylene glycol harmless to a human body.

Hereinafter, the operation of the cooling system according to the present invention is described in detail with reference to FIG. 6.

In operation of the cooling system, as electric power is supplied to the compressor 62 by operation of a user, the refrigerant staffs to circulate through the closed cooling system consisting of the condenser 54 the compressor 62, the expansion valve 50 and the heat-exchanging unit 34 etc.

Subsequently, the pump 32 forces the coolant to circulate the heat-exchanging unit 34. The coolant is indirectly cooled by the refrigerant in the exchanging unit 34 and then is supplied to the cooling tools 26 via the inlet-interconnecting hose 44 for introducing coolant. Consequently, with the assistance of the cooling tools 26, the coating blade 14 can be maintained at a desired temperature, at which the accumulation of the coating color is effectively inhibited, thereby reducing a streaking and/or a bleeding phenomena caused by the accumulation of the coating color.

Preferably, the temperature of coolant being introduced into the cooling tools 26 is maintained within a range of −15° C.~25° C. More preferably, the temperature of the coolant should be maintained within a range of −15° C.~0° C., which is optimized for preventing a streaking and/or a bleeding phenomena. If the temperature of coolant becomes below −15° C., a contacting portion between the cooling tools 26 and the coating blade 14 may freeze, which results in slightly urging the coating blade to shift from the originally configured state, whereby the imperfection of the coated paper may arise. Furthermore, such a low temperature may cause the degradation of fluidity of the coating color leading to lower workability.

If the temperature of coolant becomes over 25° C., a proper cooling effect against the coating blade cannot be expected, so that the purpose of the invention, inhibiting a bleeding and/or a streaking, may not be accomplished.

After cooling the coating blade, the coolant passing through the cooling tool 26 is redirected to the heat-exchanging unit 34 by the pump 32 or flows into the coolant tank 36. As described above, the heat-exchanging unit 34 is equipped with the temperature controller 58 for sensing and adjusting the temperature of the coolant currently circulating therein. The temperature controller 58 senses the temperature of the coolant circulating in the heat-exchanging unit 34 and subsequently provides a control unit with corresponding signals. Accordingly, the control unit controls on/off operation of the solenoid valve 52 in response to the signals from the temperature controller 58, so that the refrigerant provided to the heat-exchanging unit 34 can be adjusted.

As the foregoing, a cooling system for a paper coating device according to the present invention are advantageous in effectively preventing a stalagmite formation of coating color at the end of the coating blade by providing various cooling means for a coating blade. Therefore, it is possible to significantly reduce bleeding and streaking phenomena caused by the formation of the stalagmite during a paper coating operation, thereby improving productivity and quality of coated paper.

Even though the present invention is described in detail with reference to the foregoing embodiments, it is not intended to limit the scope of the present invention thereto. It is evident from the foregoing that many variations and modifications may be made by a person having an ordinary skill in the present field without departing from the essential concept of the present invention.

What is claimed is:

1. A paper coating device, comprising:

a backing roll for continuously transferring paper web;

a nozzle for injecting coating color to the paper web, the nozzle being disposed adjacent to a lower end of the backing roll;

a coating blade for applying and metering the coating color onto the paper web in an evenly distributed manner;

a profile tube configuring the profile of the coating blade;

a means for cooling down the coating blade, the cooling means being installed to a void space between a reverse surface of the coating blade and the profile tube; and a coolant circulating system for forcibly circulating coolant through the cooling means, wherein the means for cooling consists of two pipes located at an upper part and a lower part of the reverse surface of the coating blade, respectively, and a plurality of spray nozzles installed on the pipes, the spray nozzles being spaced at regular intervals with each other, wherein the spray nozzles directly inject the coolant against the reverse surface of the coating blade.

2. The paper coating device according to claim 1, wherein the cooling means includes cooling pipes, each having a zigzag path, which is tightly attached to the reverse surface of the coating blade.

3. The paper coating device according to claim 1, wherein the cooling means includes cooling pipes, each having an aperture thereon for debouchment of the coolant.

4. The paper coating device according to claim 1, wherein the cooling means includes a cooling compartment defined by partition walls encompassing a void space between the reverse surface of the coating blade and the profile tube, the partition walls being furnished with an inlet and an outlet for communicating with the coolant circulating system.

5. The paper coating device according to claim 1, wherein the coolant circulating system comprises a coolant tank, a coolant pump, a coolant supplying line interconnecting the coolant pump and the cooling means, and a coolant withdrawing line for redirecting the coolant being discharged from the cooling means to the coolant pump.

6. The paper coating device according to claim 1, further comprising a lid for covering an upper part of the void space defined by the reverse surface of the coating blade and the profile tube in order to prevent the coolant from being dispersedly escaped.

7. The paper coating device according to claim 5, wherein the coolant tank is further provided with a temperature controller therein.

8. The paper coating device according to claim 1, wherein the cooling means comprises coolant having a temperature range between −15° C. and 25° C., which is configured to circulate through the cooling means by the coolant circulating system.

9. The paper coating device according to claim 1, wherein the cooling means comprises coolant having a temperature range between −15° C. and 0° C., which is configured to circulate through the cooling means by the coolant circulating system.

10. A paper coating device, comprising:

a backing roll for continuously transferring paper web;

a nozzle for injecting coating color to the paper web, the nozzle being disposed adjacent to a lower end of the backing roll;

a coating blade for applying and metering the coating color onto the paper web in an evenly distributed manner;

a profile tube for configuring the profile of the coating blade;

a cooling tool for cooling down the coating blade, the cooling tool installed to a void space between a reverse surface of the coating blade and the profile tube;

interconnecting hoses provided at both ends of the cooling tool;

a pump being in fluid communication with one of the interconnecting hose which is for introducing coolant into the cooling tool;

a heat-exchanging unit installed between the pump and one of the interconnecting hoses which is for discharging coolant from the cooling tool; and a refrigerator indirectly heat-exchanging with the coolant at the heat-exchanging unit via refrigerant circulating therein.

11. The paper coating device according to claim 10, wherein the cooling tool is a copper pipe in which the coolant flows, the copper pipe tightly attached to the reverse surface of the coating blade.

12. The paper coating device according to claim 10, further comprising a coolant reservoir that is installed between the pump and one of the interconnecting hoses that is for discharging coolant from the cooling tool.

13. The paper coating device according to claim 10, wherein the heat-exchanging unit is composed of:

a housing defining a coolant circulating compartment;

an inlet and an outlet for communicating coolant, being formed at one side of the housing; and a refrigerant circulating line which partially introduced into the housing at the other side of the housing.

14. The paper coating device according to claim 10, wherein the heat-exchanging unit is further equipped with a temperature controller that senses the temperature of the coolant and accordingly adjusts the temperature of the coolant.

15. The paper coating device according to claim 10, wherein a coolant valve is further provided between an outlet of the heat-exchanging unit and one of the interconnecting hoses for introducing coolant into the cooling tool.

* * * * *